US010952286B2

(12) United States Patent
Strupinskiy

(10) Patent No.: US 10,952,286 B2
(45) Date of Patent: Mar. 16, 2021

(54) SKIN-EFFECT BASED HEATING CABLE, HEATING UNIT AND METHOD

(71) Applicant: Mikhail Leonidovich Strupinskiy, Moscow (RU)

(72) Inventor: Mikhail Leonidovich Strupinskiy, Moscow (RU)

( * ) Notice: Subject to any disclaimer, the term of this patent is extended or adjusted under 35 U.S.C. 154(b) by 157 days.

(21) Appl. No.: 16/058,961

(22) Filed: Aug. 8, 2018

(65) Prior Publication Data

US 2019/0045587 A1 Feb. 7, 2019

Related U.S. Application Data

(63) Continuation of application No. 14/701,473, filed on Apr. 30, 2015, now abandoned.

(30) Foreign Application Priority Data

Mar. 12, 2015 (RU) ..... RU2015108671

(51) Int. Cl.

| | |
|---|---|
| ***H05B 6/10*** | (2006.01) |
| ***E21B 36/04*** | (2006.01) |
| ***H01B 7/00*** | (2006.01) |
| ***H01B 7/18*** | (2006.01) |
| ***H01B 7/20*** | (2006.01) |
| ***H01B 7/22*** | (2006.01) |
| ***H01B 7/42*** | (2006.01) |

(52) U.S. Cl.

CPC ..... *H05B 6/10* (2013.01); *E21B 36/04* (2013.01); *H01B 7/0009* (2013.01); *H01B 7/1875* (2013.01); *H01B 7/20* (2013.01); *H01B 7/228* (2013.01); *H01B 7/428* (2013.01); *H05B 6/105* (2013.01); *H05B 2214/03* (2013.01)

(58) Field of Classification Search

CPC ..... H05B 6/10; H05B 6/105; H05B 2214/03; H01B 7/428; H01B 7/228; H01B 7/20; H01B 7/1875; H01B 7/0009

USPC ..... 219/544, 548, 629, 632, 667

See application file for complete search history.

(56) References Cited

U.S. PATENT DOCUMENTS 3,718,804 A 2/1973 Ando
3,777,117 A 12/1973 Othmer
3,809,846 A * 5/1974 Baumgartner ..... C30B 13/20 219/638

(Continued)

FOREIGN PATENT DOCUMENTS

CN 1717529 A 1/2006
CN 1946919 A 4/2007

(Continued)

*Primary Examiner* — Thien S Tran
(74) *Attorney, Agent, or Firm* — Inventa Capital PLC

(57) ABSTRACT

The invention relates to the skin-effect based induction-resistive heating units and can be used in devices intended for prevention of paraffin-hydrate deposits formation in oil-and-gas wells and pipelines, as well as for warming up of viscous products in pipelines and vessels for the purpose of their transporting and pumping. The skin-effect based heating cable contains the center conductor, the inner insulation layer and the ferromagnetic outer conductor coaxially located around them. The invention enables to simplify using due to increase of the heating cable flexibility and due to reduce the energy consumption at its operation.

11 Claims, 2 Drawing Sheets

(56) References Cited

U.S. PATENT DOCUMENTS

Figure 1:
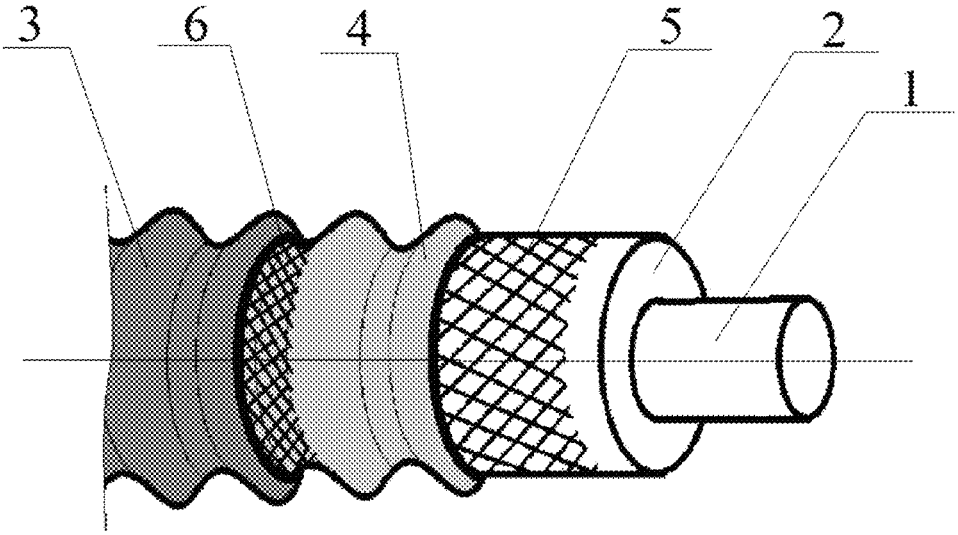

| | | | | | |
|---|---|---|---|---|---|
| 4,303,826 | A * | 12/1981 | Ando | F16L 53/34 | 392/469 |
| 4,617,449 | A | 10/1986 | Weitzel et al. | | |
| 4,631,392 | A | 12/1986 | O'Brien et al. | | |
| 4,717,814 | A * | 1/1988 | Krumme | B23K 3/0475 | 219/549 |
| 5,182,792 | A * | 1/1993 | Goncalves | E21B 17/206 | 392/468 |
| 5,266,764 | A * | 11/1993 | Fox | H05B 6/362 | 156/272.2 |
| 2011/0244721 | A1* | 10/2011 | Amidon | H01R 24/44 | 439/578 |
| 2012/0018421 | A1* | 1/2012 | Parman | H05B 3/56 | 219/546 |
| 2012/0129385 | A1* | 5/2012 | Amato | B32B 15/09 | 439/502 |
| 2013/0206748 | A1* | 8/2013 | Vinegar | E21B 43/24 | 219/542 |

FOREIGN PATENT DOCUMENTS

| | | | |
|---|---|---|---|
| CN | 202026487 | U | 11/2011 |
| CN | 103857080 | A | 6/2014 |
| EP | 0473369 | A1 | 3/1992 |
| RU | 2531292 | C2 | 5/2013 |
| RU | 2516219 | C2 | 5/2014 |
| WO | 2010114547 | A1 | 10/2010 |

* cited by examiner

SKIN-EFFECT BASED HEATING CABLE, HEATING UNIT AND METHOD

RELATED APPLICATIONS

This application is a continuation application that claims priority to U.S. non-provisional application Ser. No. 14/701,473, filed on Apr. 30, 2015, and incorporated herewith by reference in its entirety.

FIELD OF THE INVENTION

The invention relates to skin-effect based induction-resistive heating units and can be applied in devices intended for prevention of paraffin-hydrate deposits formation in oil-and-gas wells and pipelines, as well as for warming up of viscous products in pipelines and vessels for the purpose of their transporting and pumping.

BACKGROUND OF THE INVENTION

In the prior art, a skin-effect based heating cable for heating of oil wells and surrounding formations is known, containing center conductor, inner insulation layer and ferromagnetic outer conductor coaxially located around them (see Patent RU 2531292 published on 20 Oct. 2014). In the known cable, the inner insulation layer is made of nonorganic ceramic and the outer conductor has a wall thickness not less than three skin depths at the operating power voltage frequency. Disadvantages of the known cable are a thick-wall load-bearing outer conductor, not protected from corrosive environment, featuring a significant bending radius (caused by thick walls and compacted mineral insulation) and lack of constructional possibilities of output power adjustment along the longitudinal cable axis. As a consequence of this, the cable run-in-hole/put-out-of-hole operations require very expensive coiled tubing equipment, and the lack of the output power longitudinal control leads to increased electric energy consumption.

A heating unit is also known from the above source, consisting of a segment of the said cable and an AC power source, as well as a heating method involving application of the said heating unit. These technical solutions feature the same disadvantages.

The object of the invention is removal of the above disadvantages. The technical result means an improvement of the operational properties by virtue of reduction of energy consumption and heating temperature, possibility of the conductor's wall thickness lowering and thus an increase of the heating cable flexibility.

SUMMARY OF THE INVENTION

So far as relevant to the heating cable, the formulated problem is solved and the technical result is achieved by that in the proposed skin-effect based cable containing center conductor, inner insulation layer and ferromagnetic outer conductor coaxially located around them, the inner insulation layer is made of a polymer material and the outer conductor is made in form of corrugated ferromagnetic steel tube with the wall thickness less than three skin depths at the supply voltage operating frequency. The outer conductor is provided with a layer of non-ferromagnetic high-conductivity conductor made with a possibility of variation of its cross-section along the longitudinal axis of the cable and located between the corrugated ferromagnetic steel tube and the inner insulation layer. The said layer can be made in form of a braid of non-insulated high-conductivity conductors. The outer conductor is also preferably provided with an outer braid of ferromagnetic steel wires located above the corrugated tube. The center conductor can be made of one or at least two helically twisted non-ferromagnetic high-conductivity conductors or in form of a load-bearing element helically wound by at least two non-ferromagnetic high-conductivity conductors. A polymer outer sheath is preferably located above the outer conductor.

So far as relevant to the heating unit, the formulated problem is solved and the technical result is achieved by that the proposed heating unit consists of a segment of the above described heating cable and a two-phase AC power source in which the first output of the AC supply is connected to the proximal end of the center conductor and the second output—to the proximal end of the outer conductor, at that at the distal end of the said cable segment the center and the outer conductors are connected to each other. The layer of the non-ferromagnetic high-conductivity conductor and the outer braid of ferromagnetic steel wires the outer conductor of the heating cable can be provided with, are connected to the corrugated ferromagnetic steel tube at both proximal and distal ends of the cable segment. The AC power source is preferably made with a possibility of regulation of its frequency and output supply voltage.

So far as relevant to the heating method, the formulated problem is solved and the technical result is achieved by that the proposed method consists in the heating with the use of the skin-effect in the outer conductor of the heating cable by applying the current of industrial frequency to the input of the said heating unit. When the current from an industrial electric network is applied, the frequency and the output voltage of the AC power source are preferably regulated.

Other advantages and meritorious features of this invention will be more fully understood from the following description of the preferred embodiment, the appended claims, and the drawings; a brief description of which follows.

DETAILED DESCRIPTION OF THE INVENTION

Figure 2:
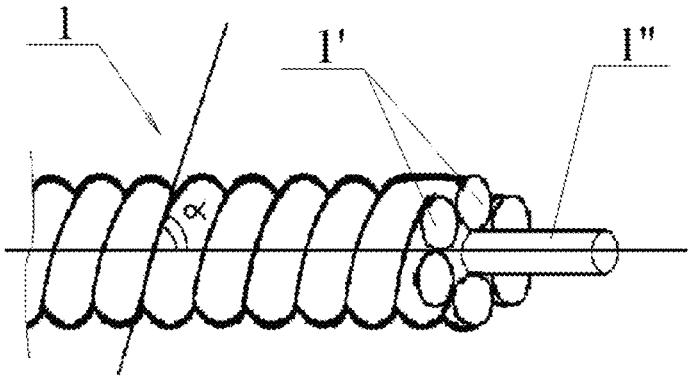

In FIG. 1 the proposed heating cable is presented;

In FIG. 2 the center conductor in form of a load-bearing element helically wound by six non-ferromagnetic high-conductivity conductors is presented.

Figure 3:
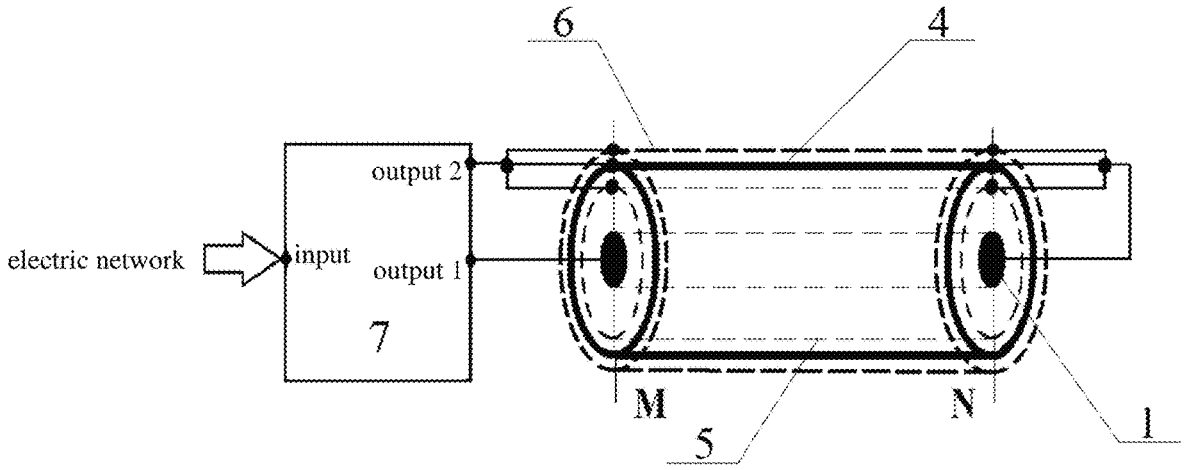

In FIG. 3 the diagram of the cable connection to an AC power source is shown.

DETAILED DESCRIPTION OF THE INVENTION

A proposed skin-effect based heating cable consists of the center conductor 1, the inner insulation layer 2 made of heat-resistant polymer material, the composite outer conductor coaxially located around them, and the outer polymer sheath 3.

The center conductor 1 can be made of one, two or more non-ferromagnetic high-conductivity conductors 1'. To increase the load-bearing capacity of the cable, the non-ferromagnetic conductors 1' can be helically wound around the center load-bearing element 1". The selection of a material for the non-ferromagnetic conductors 1', their number and cross-section as well as the selection of a material for the center load-bearing element 1" are entirely based on the ambient conditions in which the cable shall operate. The material of the non-ferromagnetic conductors can be, in particular, copper or aluminium. The center load-bearing element 1", non-ferromagnetic, can be made of, in particular, steel, polymer or composite fiber, and its design can be made in the form of, in particular, a rope, tube, harness, etc.

Choice of large cross-section of the non-ferromagnetic conductors 1', large winding angle α and presence of the load-bearing element 1" significantly increase the load-bearing capacity of the cable. In addition, large air voids formed by the conductors 1' of large cross-section inclined at an angle α to the longitudinal axis of the cable and, accordingly, to the load-bearing element 1", increase multiply interlocking of the said elements of the cable and the insulation layer 2 that excludes slipping of the cable design elements relative to each other when the cable is installed vertically and fixed at a single top point. The load-bearing capacity of the cable in this case is determined not only by using of the load-bearing element 1", but also by the design features of each element of the cables design individually.

The material for the inner insulation layer 2 can be any polymer ensuring sufficient resistance of the insulation when it operates under the cable supply voltage, and heat resistance within a wide temperature range. The lower value of the operating temperature range is understood as to be the minimum possible installation temperature of the claimed heating cable, and the upper value is determined by the maximum allowable temperature on the cable surface. In particular, using of the polyethylene cross-linked by any known method is possible for the heating of oil-and-gas wells. Wide operating temperature range can be ensured by using of fluoropolymers.

An additional outer sheath 3 is made of polymers heat resistant and chemically resistant to the ambient conditions that improves sealing capacity of the cable, protects it against corrosion and environmental conditions and brings its electrical and explosion safety up to the Category HA according to GOST P51330.9-99. Depending on possible operating conditions, the material of the outer sheath 3 can be, in particular, one of oil-and-petrol resistant polypropylene copolymers or a fluoropolymer.

The outer conductor can be made as composite in form of corrugated ferromagnetic steel tube 4 with additional components. That is: the second component—the layer 5 of non-insulated non-ferromagnetic high-conductivity conductor, and the third component—the braid 6 of ferromagnetic steel wires. Depending on the required characteristics, the outer conductor can be made as single-component (only in the form of a tube 4), two-component (a tube 4 with a layer 5) and also three-component (a tube 4 with a layer 5 and a braid 6).

It is generally accepted to use in the course of skin-systems design the thickness of the ferromagnetic outer conductor more or equal to the skin-depth determined as the depth at which the magnetic flux density decreases by e times in a ferromagnetic conductor cross-section. As practice shows, in this case an electric potential on the outer surface of a ferromagnetic conductor is as small that it is even not customary to insulate the conductor. But in this case the cable weight and flexibility are significantly influenced.

According to the invention, it is proposed to use a corrugated tube 4 of ferromagnetic steel as a main component of the outer conductor. The wall thickness of the said tube in the proposed cable is less than three skin depths at the supply voltage operating frequency and it is determined by a set of electrical and mechanical restriction imposed. The corrugation parameters determine the mechanical strength of the tube and the increase of the heat transfer area. The corrugation coefficient, $$K_r \approx 1 + 3.4 \cdot \left( \frac{ht}{4h^2 + t^2} \right)^2,$$

where h is the corrugation height and t is the corrugation pitch, falls within the range from 1.15 to 1.5 and determines the actual increase of the heat transfer area.

The use of the corrugated surface enables to achieve several substantial results at once. First, the decrease of the tube 4 wall thickness and application of polymer inner insulation layer 2 makes it possible to obtain a very flexible cable with the bending radius 400 mm that significantly simplifies the using. Second, the heat transfer surface of the cable is significantly (by up to 50%) increased and, consequently, the heating temperature of the cable surface is lowered and, as a result, the energy consumption is lower compared with that of a cable with the traditional cylindrical shape. Third, this shape enables to avoid "slipping" of the cable design elements relative to each other in case of the cable vertical installation (fixture at a single top point) and long length (above 1 km). Forth, the loading capacity of the proposed cable can be increased up to 2 km of the own length and its resistance to the ambient pressure—up to 110 atm.

The layer 5 of non-insulated non-ferromagnetic high resistivity conductor is located between the corrugated tube 4 and the inner insulation layer 2. The layer 5 is made with a feature of a possibility of its cross-section variation along the longitudinal axis of the cable that makes it possible to modify the effective cross-section of the outer conductor on a specified cable segment and optionally vary the output power, i.e. the temperature on the cable surface. The electric current flowing through the components of the outer conductor is the stronger the higher is the electric resistance of the layer 5. When there is no such a layer, its resistance is conventionally accepted to be indefinite. The regulation of the flowing current is effected by variation of the cross-section of the layer 5. If the layer 5 is made in the form of a braid, for that purpose, depending on the task at hand, the number of the wires forming the braid for the layer 5 is varied (increased or decreased) as well as the braid coverage. To increase the temperature on the cable surface (at the constant supply voltage), the number of conductors in the layer 5 should be increased, and to lower the temperature it should be decreased.

There can be any number of the cable segments with different braid coverage of the layer 5 along the cable with any lengths of these segments. To increase the dynamic range of the shunt resistance regulation, it is advisable to make it from a great number of thin conductors. The material for the braid conductors' manufacturing can be, in particular, copper or other high-conductivity material. So, foreknowing the temperature profile (geothermal one for a well) along the cable installation place and introducing the required correction of this profile by varying the cross-section of the layer 5, it is possible to substantially minimize the energy consumption for the object heating and prolong the cable operating lifetime.

The outer braid 6 can be made of a ferromagnetic steel wire and located above the corrugated steel tube 4 under the outer sheath 3; while retaining the flexibility it enables to remove the electrical potential on the outer surface of the outer conductor.

The heating unit made on the basis of the proposed cable is formed by the connection of the cable segment MN to the two-phase AC power source 7 made with a possibility of regulation of its frequency and output supply voltage. The first output of the source 7 is connected to the proximal end M of the center conductor 1 and the other output—to the proximal end M of the outer conductor (tube 4). At that at the distal end N of the said cable segment, the center (1) and the outer conductors are connected to each other. If the outer conductor contains the layer 5 and/or the braid 6, though all the components have a reliable electrical contact with each other along the whole length of the cable segment MN, they are additionally connected at the proximal end M and at the distal end N to each other and to the corrugated ferromagnetic steel tube 4.

According to the proposed heating method, the heating of the cable segment MN surface is performed after applying the supply voltage of the industrial frequency to the input of the power source 7 which can be controlled by any known control and monitoring system of two-phase AC supply sources.

Due to the above described design, the proposed heating cable processes:

an increased flexibility, with the bending radius up to 400 mm;

resistance to chemical compounds being a part of the heating fluid;

resistance to ambient pressure of up to 110 atm and tensile force of up to 15 kN;

low energy consumption.

The invention enables to simplify the using due to application of standard equipment for handling of flexible logging cable and processes constructional possibilities of the regulation of the power output on the heating cable surface along its longitudinal axis and according to the temperature profile (geothermal one for a well) of the heated object or the customer demands, using AC current with regulated frequency and output voltage.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A heating cable comprising:

a center conductor comprising a helically twisted non-ferromagnetic conductor;

an inner insulation layer coaxially located around the center conductor;

a ferromagnetic outer conductor coaxially located around the center conductor and around the inner insulation layer; and a layer of non-ferromagnetic conductor in electric contact with the outer conductor coaxially located between the outer conductor and the inner insulation layer, wherein the inner insulation layer is made of a polymer material;

wherein the outer conductor comprises a corrugated ferromagnetic tube;

wherein the ferromagnetic tube has wall thickness less than three skin-effect depths at an operating frequency.

2. The heating cable of claim 1, wherein the layer of non-ferromagnetic conductor comprises a braided non-insulated conductor.

3. The heating cable of claim 1, further comprising an outer ferromagnetic wire around and in contact with the outer conductor.

4. The heating cable of claim 1, wherein the center conductor comprises a load-bearing element helically wound by at least two non-ferromagnetic conductors.

5. The heating cable of claim 1, further comprising a polymer outer sheath around the outer conductor.

6. A heating apparatus comprising the heating cable of claim 1 and an AC power supply;

wherein a first output of the power supply is connected to a proximal end of the center conductor, wherein a second output of the power supply is connected to the proximal end of the outer conductor, and wherein at a distal end of the heating cable, the center conductor and the outer conductor are connected to each other.

7. The heating apparatus of claim 6, wherein the layer of non-ferromagnetic conductor comprises a braided non-insulated conductor.

8. The heating apparatus of claim 6, further comprising an outer ferromagnetic wire around and in contact with the outer conductor and the layer of non-ferromagnetic conductor at both proximal and distal ends of the cable segment.

9. The heating apparatus of claim 6, wherein the center conductor comprises a load-bearing element helically wound by at least two non-ferromagnetic conductors.

10. The heating apparatus of claim 6, further comprising a polymer outer sheath around the outer conductor.

11. The heating apparatus of claim 6, wherein frequency and voltage of the power supply are regulatable.

* * * * *